US008935895B2

(12) United States Patent
Mankowski

(10) Patent No.: US 8,935,895 B2
(45) Date of Patent: Jan. 20, 2015

(54) ROLLABLE RIDGE VENT PANEL

(71) Applicant: Quality Edge, Inc., Walker, MI (US)

(72) Inventor: John Mankowski, Fall City, WA (US)

(73) Assignee: Quality Edge, Inc., Walker, MI (US)

( * ) Notice: Subject to any disclaimer, the term of this patent is extended or adjusted under 35 U.S.C. 154(b) by 5 days.

(21) Appl. No.: 13/836,158

(22) Filed: Mar. 15, 2013

(65) Prior Publication Data

US 2014/0260005 A1 Sep. 18, 2014

(51) Int. Cl.
*E04B 7/00* (2006.01)
*E04D 13/17* (2006.01)

(52) U.S. Cl.
CPC ..... *E04D 13/176* (2013.01)
USPC ..... 52/198; 454/365

(58) Field of Classification Search
CPC ..... F24F 7/02; F24F 11/001; E04D 13/174; E04D 1/30; E04D 13/176; E04D 1/3402
USPC ..... 52/198, 199, 302.3; 454/365
See application file for complete search history.

(56) References Cited

U.S. PATENT DOCUMENTS

| | | | | |
|---|---|---|---|---|
| 2,799,214 | A | | 7/1957 | Roose |
| 3,058,542 | A | | 10/1962 | Rogalla |
| 4,221,628 | A | | 9/1980 | Rosenberg et al. |
| 4,341,304 | A | | 7/1982 | Diller |
| 4,676,147 | A | | 6/1987 | Mankowski |
| 4,817,506 | A | | 4/1989 | Cashman |
| 4,903,445 | A | | 2/1990 | Mankowski |
| 4,907,499 | A | | 3/1990 | James |
| 4,924,761 | A | | 5/1990 | MacLeod et al. |
| 4,957,037 | A | | 9/1990 | Tubbesing et al. |
| 5,009,149 | A | | 4/1991 | MacLeod et al. |
| 5,052,286 | A | | 10/1991 | Tubbesing et al. |
| 5,060,431 | A | | 10/1991 | MacLeod et al. |
| 5,070,771 | A | | 12/1991 | Mankowski |
| 5,095,810 | A | | 3/1992 | Robinson |
| 5,122,095 | A | | 6/1992 | Wolfert |
| 5,149,301 | A | | 9/1992 | Gates |
| 5,236,340 | A | | 8/1993 | Hall et al. |
| 5,288,269 | A | | 2/1994 | Hansen |
| 5,457,920 | A | | 10/1995 | Waltz |
| 5,458,538 | A | * | 10/1995 | MacLeod et al. ..... 454/365 |

(Continued)

OTHER PUBLICATIONS

Watts et al., "The Influence of Passive, Leading Edge Tubercles on Wing Performance," presented at the 12th Int. Symp. Unmanned Untethered Submersible Technology, Autonomous Undersea Systems Inst., Durham, NH, 2001 (9 pages).

*Primary Examiner* — Brian Glessner
*Assistant Examiner* — Paola Agudelo
(74) *Attorney, Agent, or Firm* — Price Heneveld LLP

(57) ABSTRACT

A rollable ridge vent panel includes first and second sidewalls, each including flexure portions. A side member extends in a direction that is parallel with the longitudinal extent of the ridge vent panel. A flex member includes a first wall and a second wall that are connected via a flex line and which flare from a top side of the ridge vent panel to a bottom side of the ridge vent panel. A first vented portion is disposed between the first sidewall and the body. A second vented portion is disposed between the second sidewall and the body. A plurality of primary buttresses are disposed in a parallel arrangement on an underside of the body, each being disposed substantially normal to the body. A plurality of secondary buttresses are disposed parallel to the plurality of primary buttresses on the underside of the body.

19 Claims, 11 Drawing Sheets

(56) References Cited

U.S. PATENT DOCUMENTS

| | | | | |
|---|---|---|---|---|
| 5,535,558 | A | 7/1996 | Rieke et al. | |
| 5,593,035 | A | 1/1997 | Taylor et al. | |
| 5,660,353 | A | 8/1997 | Adams, Jr. et al. | |
| 5,772,502 | A | 6/1998 | Smith | |
| 5,819,935 | A | 10/1998 | Lawson | |
| 5,960,904 | A | 10/1999 | Ullmann | |
| 5,996,300 | A | 12/1999 | Hamlin | |
| 6,003,668 | A | 12/1999 | Joyce | |
| 6,039,646 | A | 3/2000 | Sells | |
| 6,128,869 | A | 10/2000 | Brotherton et al. | |
| 6,233,887 | B1 | 5/2001 | Smith | |
| 6,260,315 | B1 * | 7/2001 | Smith | 52/199 |
| 6,269,905 | B1 | 8/2001 | Smith | |
| 6,277,024 | B1 * | 8/2001 | Coulton | 454/365 |
| 6,277,963 | B1 | 8/2001 | Boulton et al. | |
| 6,361,434 | B1 | 3/2002 | Brandon | |
| 6,371,847 | B2 | 4/2002 | Headrick | |
| 6,374,568 | B1 | 4/2002 | Hamlin | |
| 6,491,581 | B1 | 12/2002 | Mankowski | |
| 6,547,126 | B2 | 4/2003 | Freiborg et al. | |
| 6,579,171 | B2 | 6/2003 | Lawless, III et al. | |
| 6,684,581 | B2 * | 2/2004 | Robinson et al. | 52/198 |
| 6,769,223 | B2 | 8/2004 | Alderman | |
| 6,881,144 | B2 | 4/2005 | Hansen et al. | |
| 6,908,007 | B2 | 6/2005 | Hrdlicka | |
| 6,991,535 | B2 | 1/2006 | Ciepliski et al. | |
| 7,024,828 | B2 | 4/2006 | Headrick | |
| 7,165,363 | B2 | 1/2007 | Headrick, II et al. | |
| 7,219,473 | B2 | 5/2007 | Mantyla et al. | |
| 7,365,266 | B2 | 4/2008 | Heckeroth | |
| 7,537,518 | B2 | 5/2009 | Villela et al. | |
| 7,562,498 | B2 | 7/2009 | Galeazzo et al. | |
| 7,662,037 | B2 * | 2/2010 | Polston | 454/365 |
| 7,766,735 | B2 | 8/2010 | Ciepliski et al. | |
| 7,814,715 | B2 * | 10/2010 | Coulton et al. | 52/198 |
| 7,874,451 | B2 | 1/2011 | Bel | |
| 8,069,621 | B2 | 12/2011 | Mantyla et al. | |
| 8,322,089 | B2 * | 12/2012 | Railkar et al. | 52/198 |
| 2002/0144485 | A1 | 10/2002 | Wagner | |
| 2004/0023748 | A1 | 2/2004 | Haka | |
| 2006/0035582 | A1 | 2/2006 | Collister et al. | |
| 2007/0267310 | A1 | 11/2007 | Berkowitz et al. | |
| 2008/0287053 | A1 | 11/2008 | Carlson et al. | |
| 2008/0287054 | A1 | 11/2008 | Carlson et al. | |
| 2009/0049769 | A1 | 2/2009 | Kaseda | |
| 2009/0130969 | A1 | 5/2009 | Grisham et al. | |
| 2009/0233541 | A1 | 9/2009 | Holland et al. | |
| 2009/0249740 | A1 | 10/2009 | Crookston | |
| 2010/0112932 | A1 | 5/2010 | Grubka et al. | |
| 2010/0144266 | A1 | 6/2010 | Lowe et al. | |
| 2011/0195655 | A1 * | 8/2011 | Holland et al. | 454/365 |
| 2011/0302852 | A1 | 12/2011 | Grubka et al. | |

* cited by examiner

ROLLABLE RIDGE VENT PANEL

CROSS-REFERENCE TO RELATED APPLICATIONS

This application is related to U.S. patent application Ser. No. 13/836,297, filed on Mar. 15, 2013, entitled "RIDGE VENT WITH EXTERNAL-FLEXION VANES," and U.S. patent application Ser. No. 13/835,965, filed on Mar. 15, 2013, entitled "ROLLED RIDGE VENT DISPENSER," the entire disclosures of which are hereby incorporated herein by reference.

BACKGROUND OF THE INVENTION

The present invention generally relates to a vent panel, and more specifically, to a rollable ridge vent panel for a roof of a building.

SUMMARY OF THE PRESENT INVENTION

One aspect of the present invention includes a rollable ridge vent panel having a body including first and second sidewalls and first and second end walls. Each sidewall includes flexure portions configured to allow the ridge vent panel to transition from a rolled storage position to a linear installed position. The flexure portions include a side member that extends in a direction that is parallel with the longitudinal extent of the ridge vent panel. A flex member includes a first wall and a second wall that are connected via a flex line and which flare from a top side of the ridge vent panel to a bottom side of the ridge vent panel. A first vented portion is disposed between the first sidewall and the body. A second vented portion is disposed between the second sidewall and the body. The first and second vented portions each include laterally-extending vent supports that define a plurality of vent openings that support the flow of air therethrough. A plurality of primary buttresses are disposed in a parallel arrangement on an underside of the body, wherein each of the plurality of primary buttresses is disposed substantially normal to the body. A plurality of secondary buttresses are disposed parallel to the plurality of primary buttresses on the underside of the body. The primary and secondary buttresses are disposed in an alternating arrangement to provide increased flexibility to the first and second vented portions and a plurality of flexure vanes.

Another aspect of the present invention includes a rollable ridge vent panel having a body including first and second sidewalls and first and second end walls. Each of the first and second end walls includes a first set of lateral vents and a second set of lateral vents. The first set of lateral vents is disposed at a first angle relative to the first end wall and a second set of lateral vents is disposed at a second angle relative to the second end wall. A first vented portion is disposed between the first sidewall and the body. A second vented portion is disposed between the second sidewall and the body. The first and second vented portions each include laterally-extending vent supports that define a plurality of vent openings that support the flow of air therethrough. A plurality of stabilizing members are disposed in each of the first and second sidewalls. Each of the plurality of stabilizing members includes an at least partially triangular footprint. A plurality of primary buttresses are disposed in a parallel arrangement on an underside of the body. Each of the plurality of primary buttresses is disposed substantially normal to the body.

Yet another aspect of the present invention includes a rollable ridge vent panel having a top wall and first and second sidewalls extending downwardly from the top wall. Each of the first and second sidewalls includes a linear top edge and a bottom edge having a plurality of angular portions configured to retract when the ridge vent panel is in a rolled condition and expand when the ridge vent panel is in an installed condition. A first vented portion is disposed between the first sidewall and the body. A second vented portion is disposed between the second sidewall and the body. The first and second vented portions each include laterally-extending arcuate vent supports that define a plurality of arcuate vent openings. A plurality of primary buttresses are disposed in a parallel arrangement on an underside of the body. Each of the plurality of primary buttresses is disposed substantially normal to the body.

These and other aspects, objects, and features of the present invention will be understood and appreciated by those skilled in the art upon studying the following specification, claims, and appended drawings.

DETAILED DESCRIPTION OF EMBODIMENTS

Figure 1:
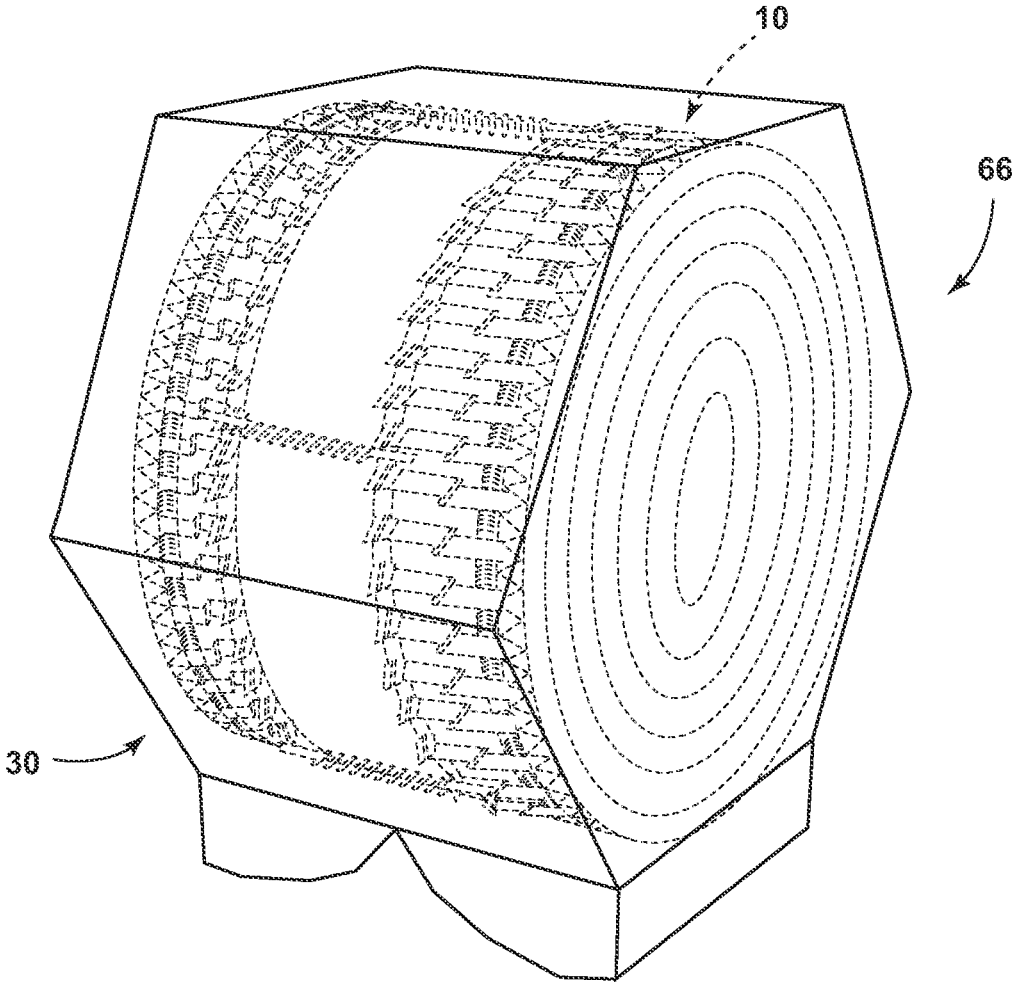
FIG. 1 is a top perspective view of one embodiment of a rollable ridge vent disposed in a ridge vent dispenser.
Figure 2:
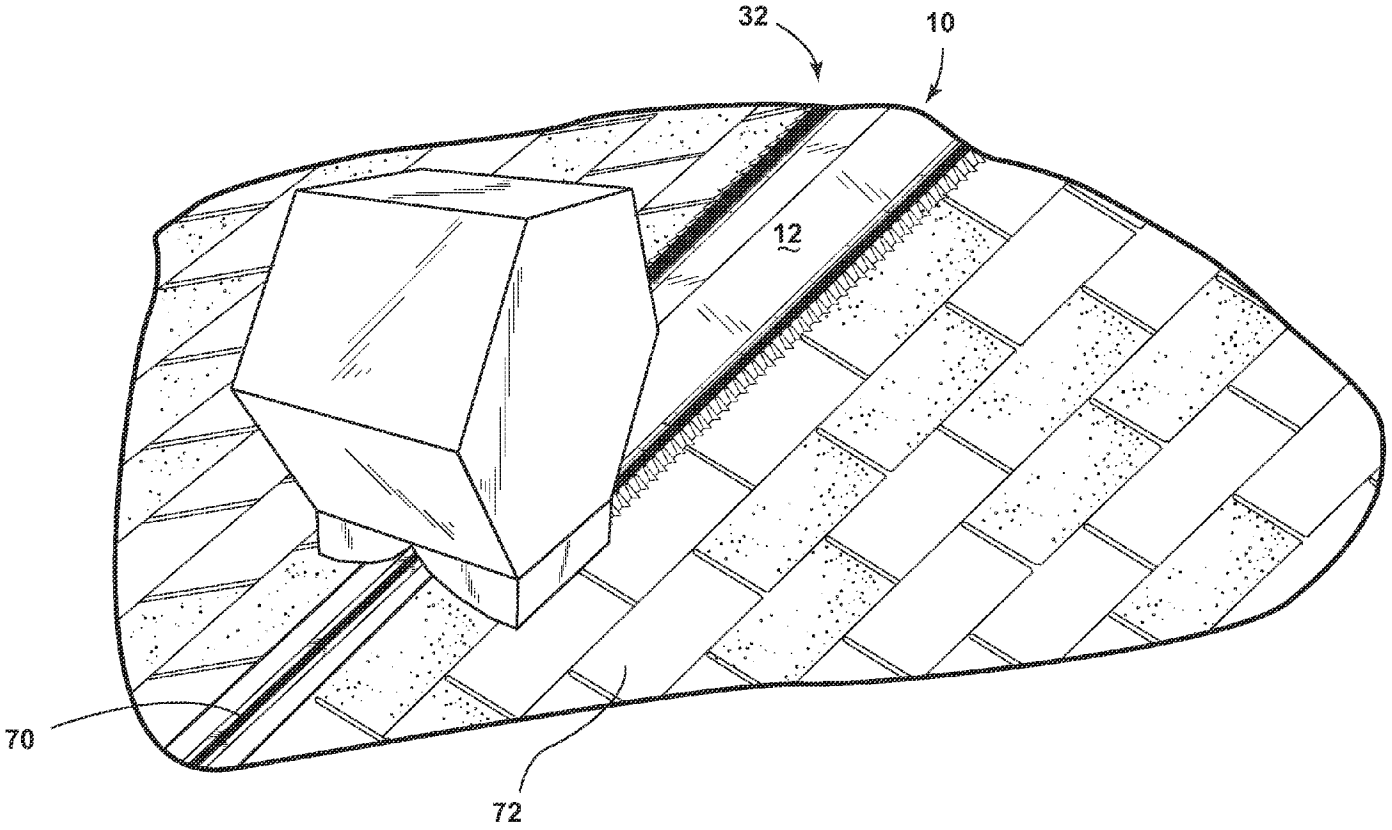
FIG. 2 is a top perspective view of one embodiment of a ridge vent dispenser during installation of a rollable ridge vent panel onto a building ridgeline.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-8, reference numeral 10 generally designates a rollable ridge vent panel having a body 12 including first and second sidewalls 14, 16 and first and second end walls 18, 20. Each of the first and second sidewalls 14, 16 includes flexure portions 22 configured to allow the rollable ridge vent panel 10 to transition from a rolled storage position 30 (shown in FIG. 1) to a linear installed position 32 (shown in FIG. 2). The flexure portions 22 include a non-flex member 33 that extends in a direction that is parallel with the longitudinal extent of the rollable ridge vent panel 10. The flexure portions 22 also include a first flex member 36 and a second flex member 38, which are connected via a flex line 40 and which flare from a top edge 42 of the rollable ridge vent panel 10 to a bottom edge 44 of the rollable ridge vent panel 10. Also, as illustrated in FIG. 3B, weep holes 45 may be positioned between the non-flex members 33 and the first flex members 36, between the non-flex members 33 and the second flex members 38, or both. As illustrated, the first flex member 36 and the second flex member 38 have a planar construction. However, a person having ordinary skill in the art will appreciate that the first flex member 36 and the second flex member 38 could be arcuate, linear, polygonal, etc. Additionally, the first and second flex members 36, 38 could recede into the body 12 or extend outwardly from the body. A first vented area 50 is disposed between the first sidewall 14 and the body 12. A second vented area 52 is disposed between the second sidewall 16 and the body 12. The first and second vented portions 50, 52 each include laterally-extending vent supports 54 that define a plurality of vent openings 56 that support the flow of air therethrough. Intermittent laterally-extending vent supports 54 may include extensions 57 that connect with a top portion of the flexure portions 22 at the flex line 40 of each flexure portion 22. The extensions 57 help orient the flexure portions 22 and keep the flexure portions 22 in orthogonal alignment relative to the body 12 of the rollable ridge vent panel 10.

A plurality of primary buttresses 60 are disposed in a parallel arrangement on an underside of the body 12, wherein each of the plurality of primary buttresses 60 extends in a direction substantially normal to the body 12. A plurality of secondary buttresses 62 are disposed parallel to the plurality of primary buttresses 60 on the underside of the body 12. The primary and secondary buttresses 60, 62 may be aligned, offset, staggered, etc. The primary and secondary buttresses 60, 62 provide some height to the rollable ridge vent panel 10, keeping the body 12 elevated above a ridgeline 70 after installation.

Referring again to FIG. 1, the rollable ridge vent panel 10 is generally configured for shipping and installation via a rollable ridge vent dispenser 66. The rollable ridge vent dispenser 66 includes a number of features, as set forth in U.S. patent application Ser. No. 13/835,965, entitled "ROLLABLE RIDGE VENT DISPENSER." However, it is also contemplated that the rollable ridge vent panel 10 may be installed without use of the rollable ridge vent dispenser 66. In this instance, the rollable ridge vent panel 10 is simply rollable along the ridgeline 70 of a roof 72 and fastened via mechanical fasteners, such as nails, along the rollable ridge vent panel 10.

Figure 3:
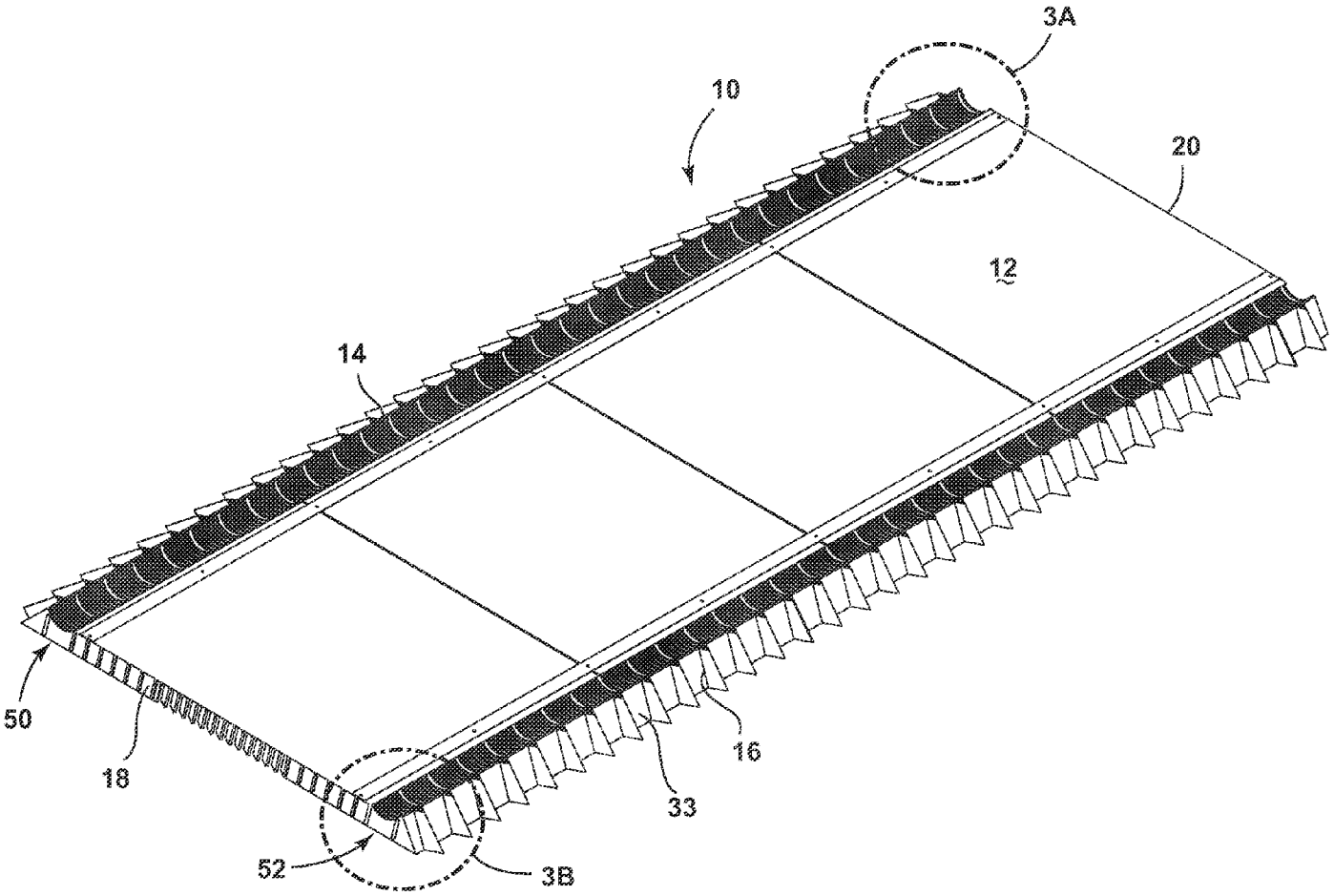
FIG. 3 is a top perspective view of one embodiment of a rollable ridge vent panel.
Figure 3A:
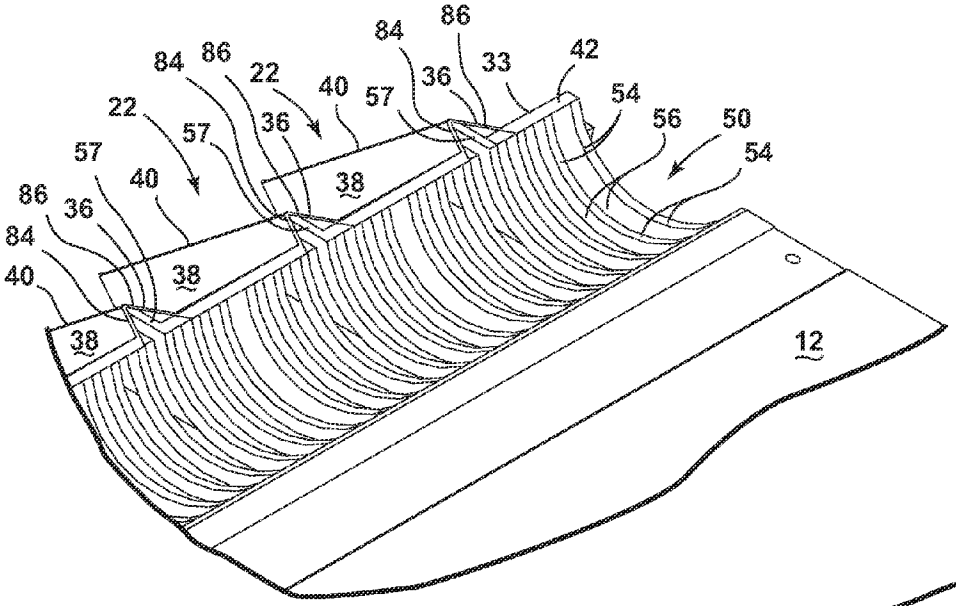
FIG. 3A is an enlarged partial top perspective view of area 3A of FIG. 3.
Figure 3B:
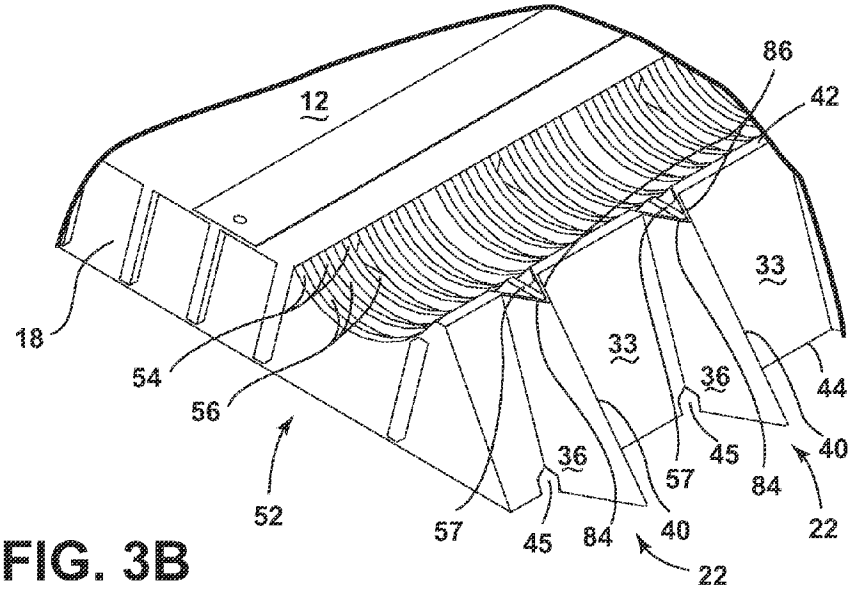
FIG. 3B is a top perspective view of area 3B of FIG. 3.
Figure 3C:
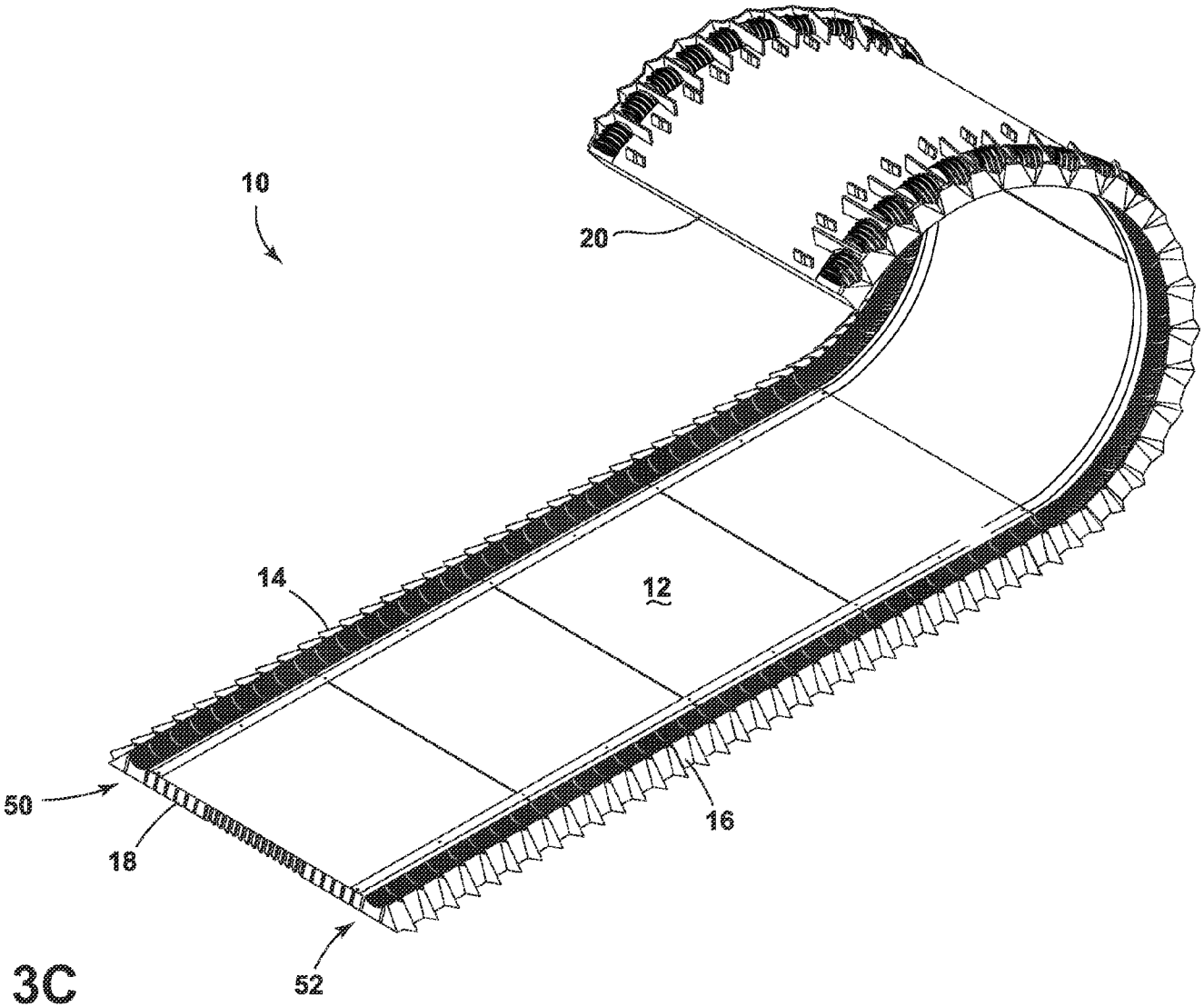
FIG. 3C is a top perspective view of the rollable ridge vent panel of FIG. 3 in a partially rolled condition.
Figure 4:
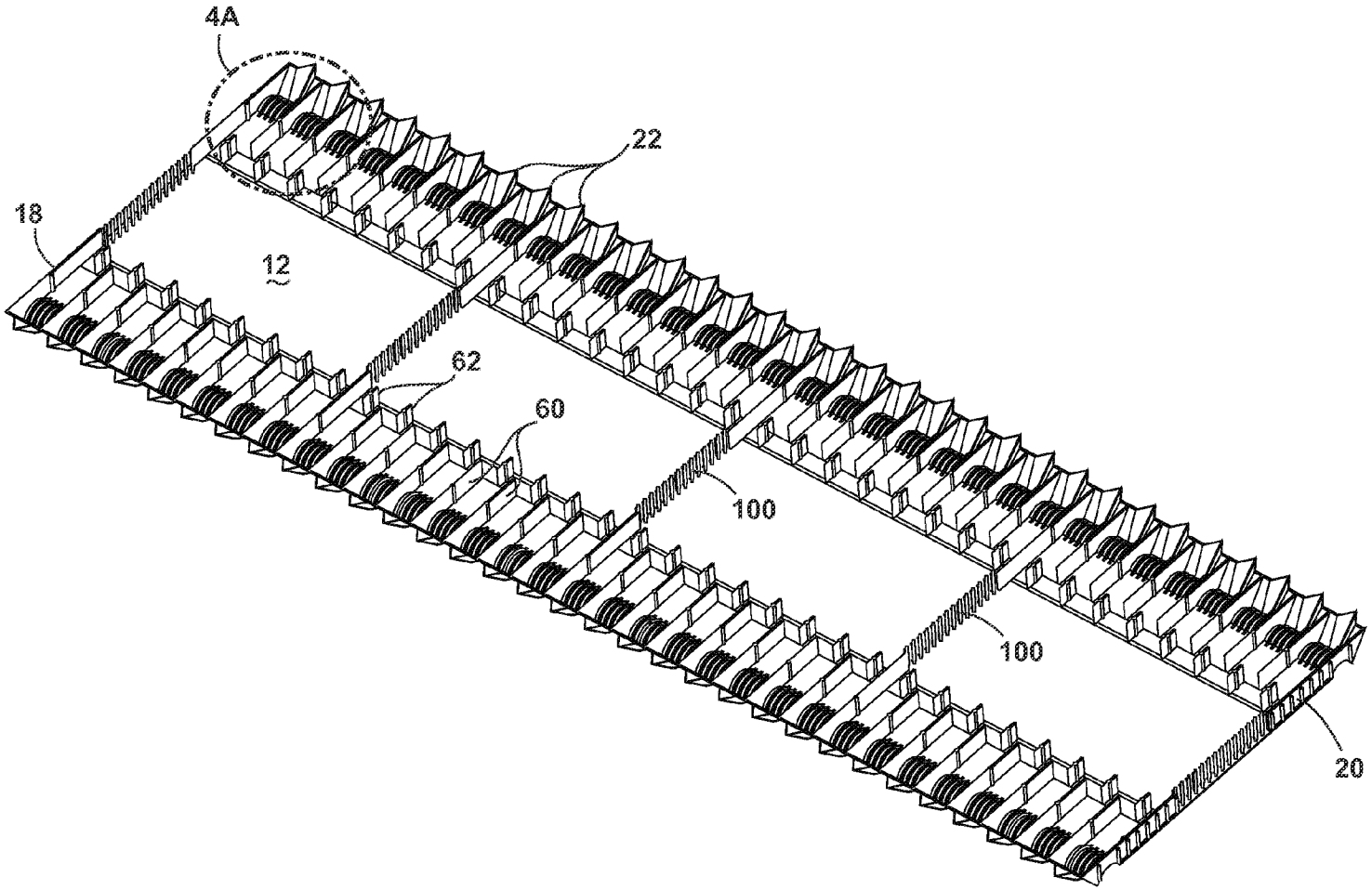
FIG. 4 is a bottom perspective view of the rollable ridge vent panel of FIG. 3.
Figure 4A:
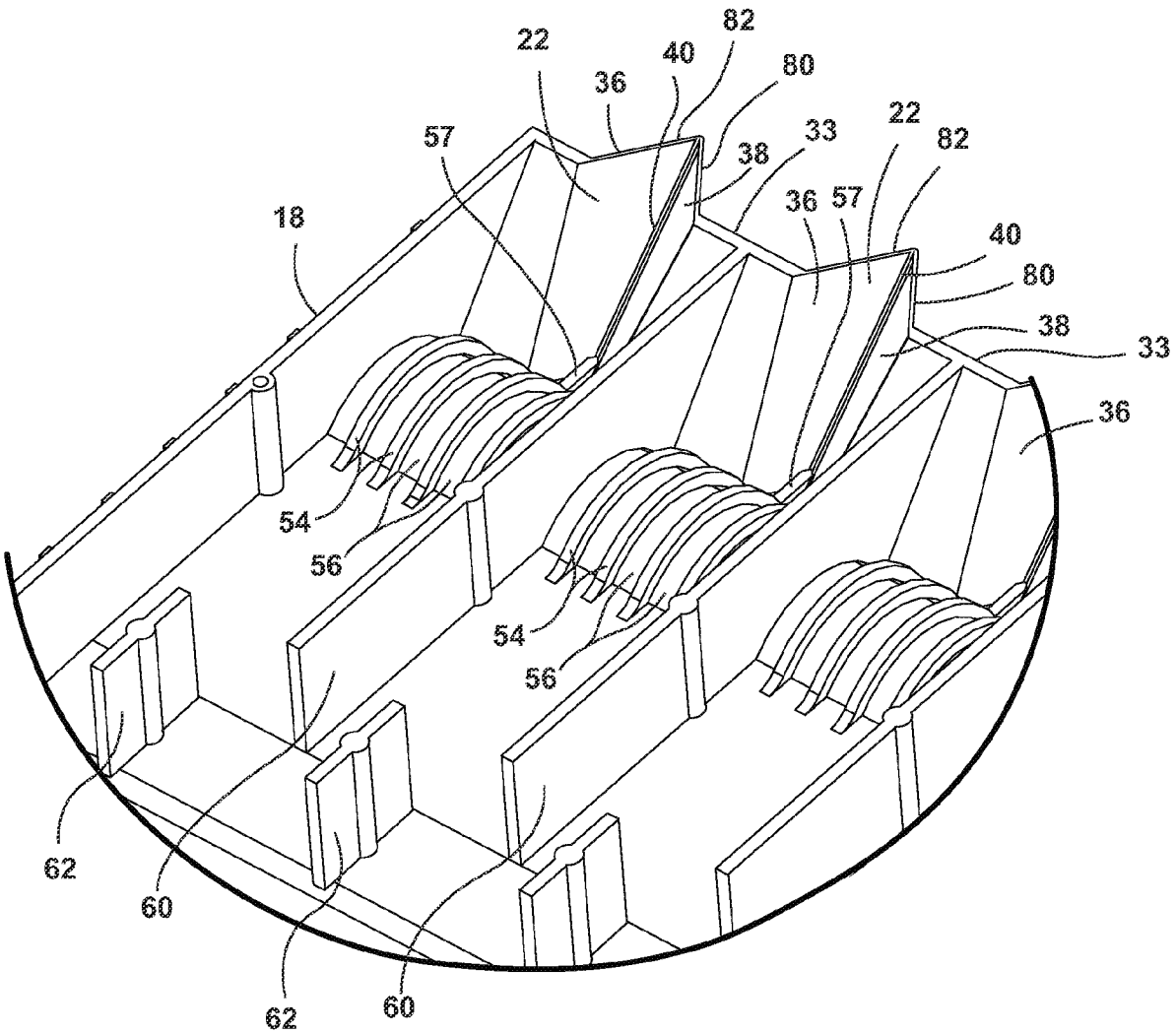
FIG. 4A is an enlarged partial bottom perspective view of area 4A of FIG. 4.
Figure 5:
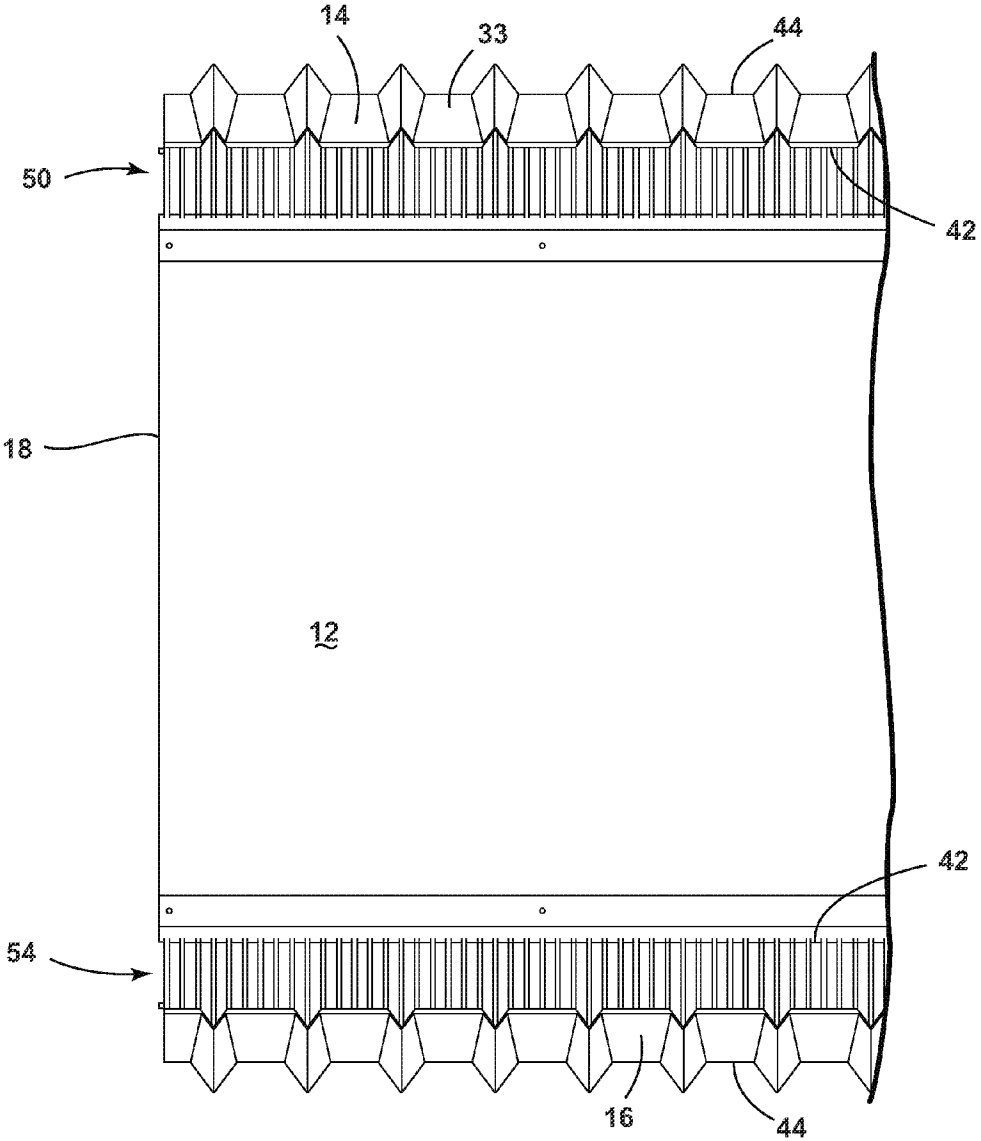
FIG. 5 is a partial top plan view of the rollable ridge vent panel of FIG. 3.
Figure 6:
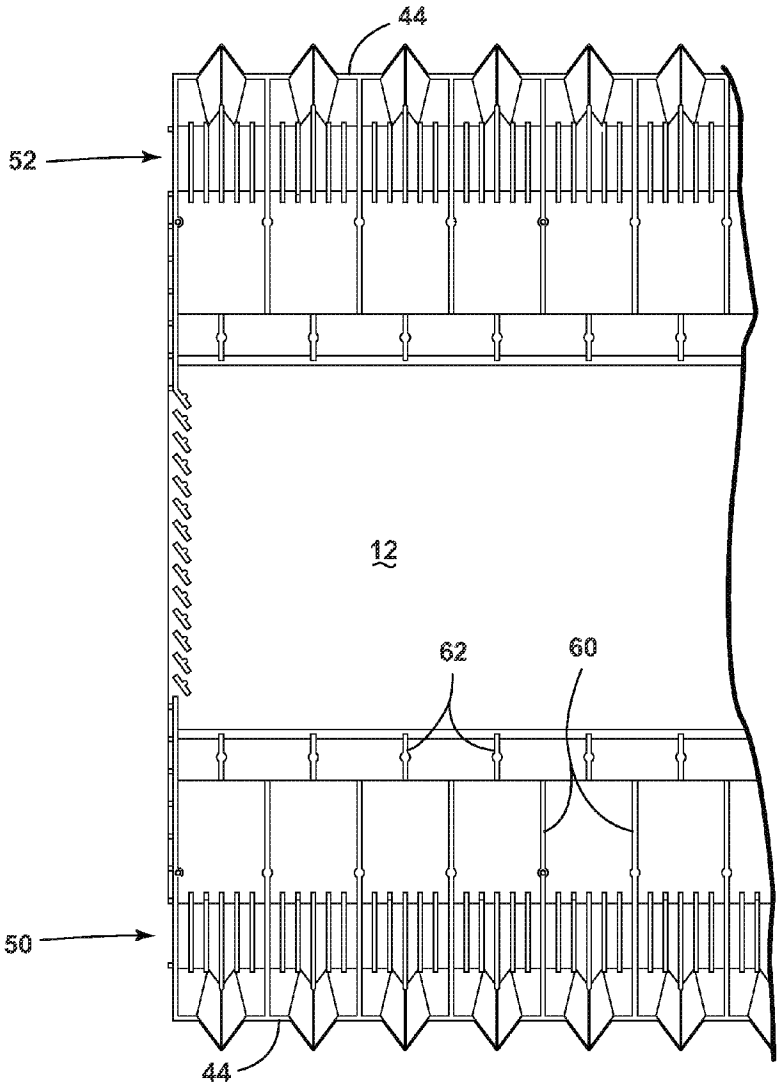
FIG. 6 is a partial bottom plan view of the rollable ridge vent panel of FIG. 3.
Figure 7:
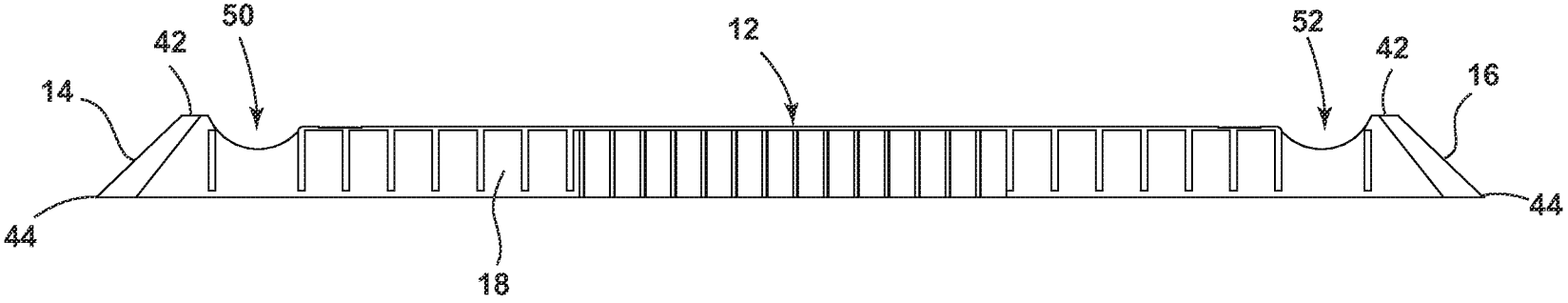
FIG. 7 is an end elevational view of the rollable ridge vent panel of FIG. 3.

Referring now to FIGS. 3-4A, the rollable ridge vent panel 10 includes first and second ends, each of which include a plurality of vent members 54 designed to allow air to pass therethrough. In a similar fashion, the first and second vented portions 50, 52 allow air to pass vertically from an area below the body 12 of the rollable ridge vent panel 10 to an area above the rollable ridge vent panel 10. The laterally-extending vent supports 54 have a generally arcuate construction and are concave up, as illustrated in FIGS. 3A and 3B. However, it will be understood that the laterally-extending vent supports 54 could also be concave down, linear, polygonal, etc. In addition, a number of laterally-extending vent supports 54 extend into the flexure portions 22 and provide additional support thereto at a top portion of the flexure portions 22. It will be noted that the laterally-extending vent supports 54 could have other constructions and be concave down, partially polygonal, flat, etc. Notably, there are no laterally-extending vent supports 54 disposed at a bottom portion of the flexure portions 22, such that the flexure portions 22 can flatten when the rollable ridge vent panel 10 is placed in a rolled condition (FIGS. 3C and 8A).

Referring again to FIGS. 3-4A, the flexure portions 22 act as stabilizing members that have an at least partially triangular footprint that extends away from the body 12 of the rollable ridge vent panel 10. These stabilizing members help to further stabilize the rollable ridge vent panel 10 on a ridgeline of a building. Additionally, the arrangement of the flexure portions 22 allow for some lateral movement to cover ridgelines that may not be straight. In addition, the flexure portions 22 are generally sized so that the rollable ridge vent panel 10 can be easily rolled without placing undue stress on the first and second sidewalls 14, 16 of the body 12. More specifically, the size of the angle between a bottom edge 80 of the first flex member 36 and a bottom edge 82 of the second flex member 38 increases, as shown in FIGS. 3C and 8A. Stated differently, the first and second flex members 36, 38 begin to spread at the flex line 40. As the first and second flex members 36, 38 spread, the angle between the bottom edge 80 and the bottom edge 82 increases. Notably, the angle between a top edge 84 of the first flex member 36 and a top edge 86 of the second flex member 38 may decrease, stay the same, or increase. In any event, the amount of angle increase will be greater at the bottom edges 80, 82 than at the top edges 84, 86 when the rollable ridge vent panel 10 is rolled.

Figure 8:
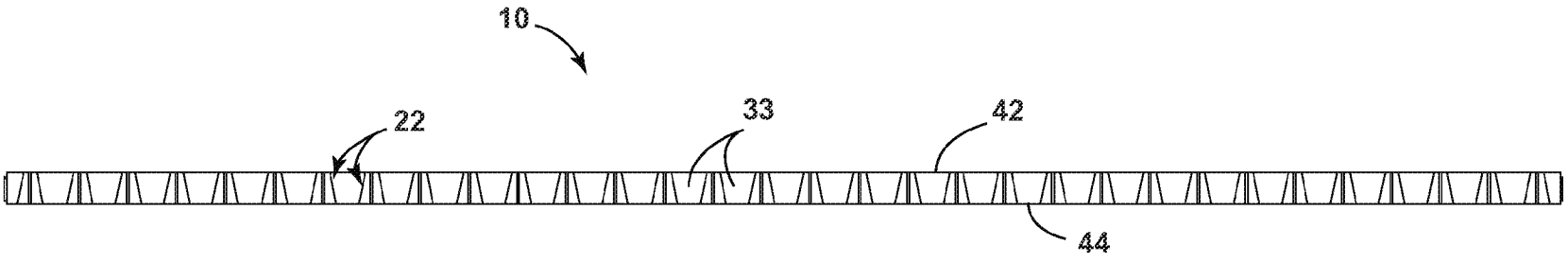
FIG. 8 is a side elevational view of the rollable ridge vent panel of FIG. 3.
Figure 8A:
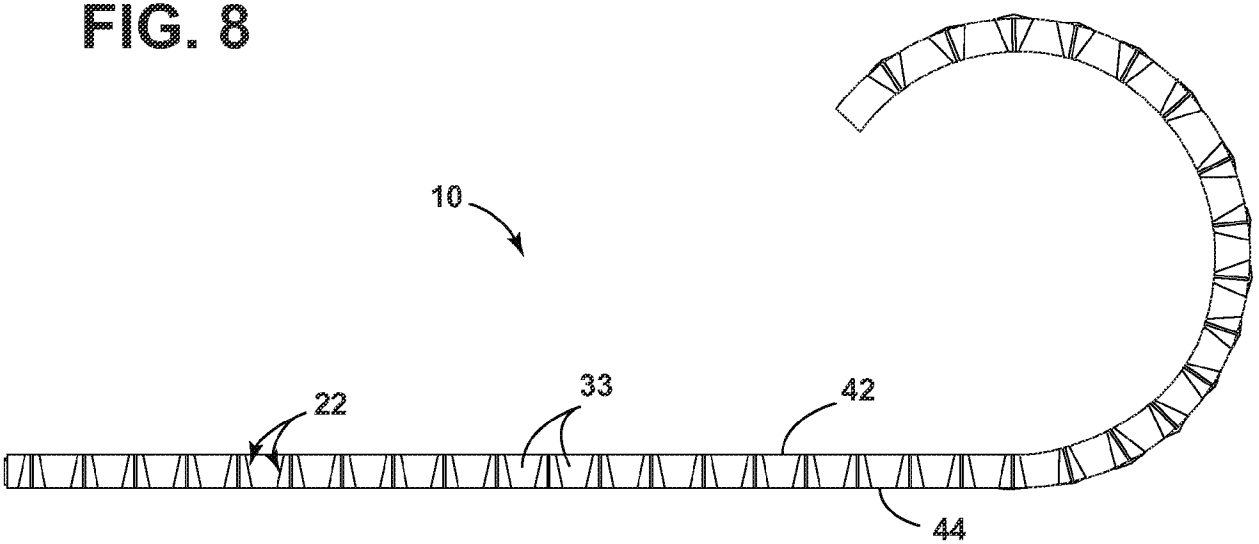
FIG. 8A is a top perspective view of the rollable ridge vent panel of FIG. 8 in a partially rolled condition.

As generally illustrated in FIGS. 3C and 8A, when the rollable ridge vent panel 10 is in the rolled storage position or condition 30, the flexure portions 22 spread or flatten out without putting undue stress on the rollable ridge vent panel 10. Accordingly, the integrity of the continuity of the first and second sidewalls 14, 16 is maintained. During installation, the flexure portions 22 maintain enough flexibility, such that when the rollable ridge vent panel 10 is being installed, the flexure portions 22 return to their original triangular configuration.

Referring now to FIGS. 4 and 4A, the primary and secondary buttresses 60, 62 are staggered to provide flexibility to the rollable ridge vent panel 10. A mid-portion of the primary and secondary buttresses 60, 62 includes an intermediate enlarged cylindrical portion. The intermediate enlarged cylindrical portion may be solid, as shown in FIGS. 4 and 4A, or may include an aperture for receiving a mechanical fastener to secure the rollable ridge vent panel 10 to the ridgeline of a building. In addition, a plurality of ribs are disposed on an end wall on the first and second end walls 18, 20. The plurality of ribs provide stability to the end wall and assist in abutting adjacent rollable ridge vent panels 10. As noted in FIGS. 4 and 4A, the flexure portions 22 generally define angular portions that are configured to retract when the rollable ridge vent panel 10 is in a rolled condition and expand when the rollable ridge vent panel 10 is in an installed condition. Regardless of whether the rollable ridge vent panel 10 is in a rolled condition or in an installed condition, the bottom edge of the flexure portions 22 generally maintains planar alignment with the primary buttresses 60, as well as a bottom edge of the first and second sidewalls 14, 16.

Referring again to FIGS. 4 and 6, the rollable ridge vent panel 10 also includes a plurality of intermediate vent baffles 100 disposed on an underside of the body 12. The intermediate vent baffles 100 extend between extended primary buttresses 60. The extended primary buttresses 60 are positioned approximately one foot apart. However, this could be larger or smaller. The extended primary buttresses 60 and the intermediate vent baffles 100 provide additional stability to the rollable ridge vent panel 10 before, during, and after installation. The primary and secondary buttresses 60, 62 and the intermediate vent baffles 100 all have approximately the same height.

The rollable ridge vent panel 10 as disclosed herein is generally configured to allow easy installation by allowing controlled flexing of the flexure portions 22 of the sidewalls 14, 16. The controlled flexing of the flexure portions 22 in the sidewalls 14, 16 is substantial, such that the rollable ridge vent panel 10 can be completely rolled onto itself and positioned in one ridge vent dispenser 66. Additionally, the angular portions or flexure portions 22 of the rollable ridge vent dispenser 66 provide greater stability of the rollable ridge vent panel 10 and allow for greater adjustability as the rollable ridge vent panel 10 is positioned along the ridgeline 70 of the roof 72 of a building. Additionally, the configuration of the rollable ridge vent panel 10 provides for increased airflow through and across the rollable ridge vent panel 10.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A rollable ridge vent panel comprising:

a body having first and second sidewalls and first and second end walls, wherein each sidewall includes flexure portions configured to allow the ridge vent panel to transition from a rolled storage position to a linear installed position, the flexure portions including:

a side member that extends in a direction that is parallel with the longitudinal extent of the ridge vent panel; and a flex member having a first wall and a second wall that are connected via a flex line, and wherein the first and second walls flare from a top side of the ridge vent panel to a bottom side of the ridge vent panel, wherein the first and second walls are in an angled position relative to each other when in the linear installed position, and wherein the first and second walls are flattened along the flex line when in the rolled storage position;

a first vented portion disposed between the first sidewall and the body;

a second vented portion disposed between the second sidewall and the body, wherein the first and second vented portions each include laterally-extending vent supports that define a plurality of vent openings that support the flow of air therethrough;

a plurality of primary buttresses disposed in a parallel arrangement on an underside of the body, wherein each of the plurality of primary buttresses is disposed substantially normal to the body; and a plurality of secondary buttresses disposed parallel to the plurality of primary buttresses on the underside of the body, the primary and secondary buttresses disposed in an alternating arrangement to provide increased flexibility to the body.

2. The rollable ridge vent panel of claim 1, wherein the first and second vented portions are substantially arcuate in shape.

3. The rollable ridge vent panel of claim 1, wherein the flexure portions are disposed on an outside surface of each of the first and second sidewalls.

4. The rollable ridge vent panel of claim 1, wherein each of the flexure portions have a generally triangular cross-section.

5. The rollable ridge vent panel of claim 1, wherein the flexure portions flatten when the ridge vent is in a rolled condition.

6. The rollable ridge vent panel of claim 1, wherein the first and second walls are planar members.

7. The rollable ridge vent panel of claim 6, wherein the first and second walls are separated by the flex line.

8. A rollable ridge vent panel comprising:

a body having first and second sidewalls and first and second end walls, wherein each of the first and second end walls includes a first set of lateral vents and a second set of lateral vents, wherein the first set of lateral vents is disposed at a first angle relative to the first end wall and a second set of lateral vents is disposed at a second angle relative to the second end wall;

a first vented portion disposed between the first sidewall and the body;

a second vented portion disposed between the second sidewall and the body, wherein the first and second vented portions each include laterally-extending vent supports that define a plurality of vent openings that support the flow of air therethrough, wherein the first and second vented portions are substantially concave along a cross section taken through the body;

a plurality of stabilizing members disposed in each of the first and second sidewalls, each of the plurality of stabilizing members having a generally triangular footprint; and a plurality of primary buttresses disposed in a parallel arrangement on an underside of the body, wherein each of the plurality of primary buttresses is disposed substantially normal to the body.

9. The rollable ridge vent panel of claim 8, wherein the first and second vented portions are substantially arcuate in shape.

10. The rollable ridge vent panel of claim 8, wherein the stabilizing members are disposed only on an outside surface of each of the first and second sidewalls.

11. The rollable ridge vent panel of claim 8, wherein the stabilizing members are substantially flattened when the ridge vent panel is in a rolled condition.

12. The rollable ridge vent panel of claim 8, wherein the first and second sidewalls include a plurality of weep holes for releasing moisture disposed under the ridge vent panel after installation.

13. The rollable ridge vent panel of claim 8, wherein the stabilizing members include first and second planar flex members.

14. The rollable ridge vent panel of claim 13, wherein the first and second planar flex members are separated by a flex line.

15. A rollable ridge vent panel comprising:

a top wall and first and second sidewalls extending downwardly from the top wall, wherein each of the first and second sidewalls includes a linear top edge and a bottom edge having a plurality of angular portions configured to retract when the ridge vent panel is in a rolled condition and expand when the ridge vent panel is in an installed condition;

a first vented portion disposed between the first sidewall and the top wall;

a second vented portion disposed between the second sidewall and the top wall, wherein the first and second vented portions each include laterally-extending arcuate vent supports that define a plurality of arcuate vent openings, wherein the vent supports are generally concave with respect to a top surface of the top wall; and a plurality of primary buttresses disposed in a parallel arrangement on an underside of the top wall, wherein each of the plurality of primary buttresses is disposed substantially normal to the top wall.

16. The rollable ridge vent panel of claim 15, further comprising:

a plurality of secondary buttresses disposed parallel to the plurality of primary buttresses on the underside of the top wall, the primary and secondary buttresses disposed in an alternating arrangement to provide increased flexibility to the first and second vented portions and the plurality of angular portions.

17. The rollable ridge vent panel of claim 15, wherein the plurality of angular portions are disposed only on an outside surface of each of the first and second sidewalls.

18. The rollable ridge vent panel of claim 15, wherein the angular portions are substantially flattened when the ridge vent panel is in a rolled condition.

19. The rollable ridge vent panel of claim 15, wherein the first and second sidewalls include a plurality of weep holes for releasing moisture disposed in the vent system.

* * * * *